US005244425A

United States Patent [19]

Tasaki et al.

[11] Patent Number: 5,244,425

[45] Date of Patent: Sep. 14, 1993

[54] WATER INJECTION PROPULSION UNIT

[75] Inventors: Hiroshi Tasaki; Kazumasa Ito; Makoto Toyohara, all of Hamamatsu, Japan

[73] Assignee: Sanshin Kogyo Kabushiki Kaisha, Hamamatsu, Japan

[21] Appl. No.: 700,766

[22] Filed: May 15, 1991

[30] Foreign Application Priority Data

May 17, 1990 [JP] Japan ..... 2-125399
Oct. 17, 1990 [JP] Japan ..... 2-276158

[51] Int. Cl.[5] ..... B63H 11/00

[52] U.S. Cl. ..... 440/47; 440/38; 114/270

[58] Field of Search ..... 239/265.11, 265.19; 60/221, 228, 230, 232; 440/38, 40, 41, 42, 47, 43; 114/270

[56] References Cited

U.S. PATENT DOCUMENTS 4,176,616 12/1979 Robins ..... 440/47

FOREIGN PATENT DOCUMENTS 56-75296 6/1981 Japan .
0262290 10/1989 Japan ..... 440/47
0124395 5/1990 Japan ..... 440/47

*Primary Examiner*—Edwin L. Swinehart
*Attorney, Agent, or Firm*—Ernest A. Beutler

[57] ABSTRACT

An arrangement is provided for variably adjusting the effective flow area along a region within a water injection propulsion unit. The invention is adapted to be embodied in a small watercraft of the type that is designed to be operated by a single rider sitting in straddle fashion on the watercraft. The flow area adjustments may be made in response to the value of a selected operating variable, or several variables, which may be measured during the operation of the watercraft. The invention allows attainment of optimum accelerability at low to medium speeds, and optimum accelerability and top speed at high speeds.

33 Claims, 11 Drawing Sheets

WATER INJECTION PROPULSION UNIT

BACKGROUND OF THE INVENTION

This invention relates to a water jet propelling vessel and more particularly to an improved water injection propulsion unit for such a vessel.

One popular form of watercraft is that of the jet propulsion type. Although this type of vessel has a number of advantages, the usual construction of the jet propulsion unit can present some difficulties.

One particular problem with this type of unit is due to the fact that the jet propulsion unit is constructed with fixed dimensions. It is thus not possible to simultaneously optimize the watercraft's accelerability and maximum attainable speed under various running conditions, as each of these normally require unique and varying jet propulsion unit dimensions. Particularly, it is not possible to increase the watercraft's accelerability during periods when the vessel speed is low, nor is it possible to maximize the vessel's top attainable speed during periods when the vessel speed is high, when employing a fixed dimension jet propulsion unit. Ordinarily, a compromise is made and the jet propulsion unit constructed in such a manner so that acceptable, but not optimal, watercraft accelerability and speed are attainable under the above-discussed conditions.

The graph of FIG. 1 illustrates the relationship of thrust and hull drag with vessel speed (wherein T is thrust, V is vessel speed, R is hull drag, A is a plot for a vessel utilizing a larger nozzle outlet area, and B is a plot for a vessel utilizing a smaller nozzle outlet area) It can be seen that utilization of a larger nozzle outlet area achieves greater thrust within the low to medium speed range while utilization of a smaller nozzle outlet area achieves greater thrust, and higher speed, within the high speed range.

It is, therefore, a principle object of this invention to provide an improved water jet propelling vessel and a construction for the jet propulsion unit for use with a watercraft.

It is a further object of this invention to provide for improved performance for such a vessel operating at varying speeds.

SUMMARY OF THE INVENTION

This invention is adapted to be embodied in a jet propelled watercraft. A prominent feature of this invention lies in a water injection propulsion unit construction for use in such a watercraft. The water injection propulsion unit is provided with a water inlet portion for admitting water into the unit, an impeller portion for containing an impeller for pumping water, and a discharge portion for discharging water from the impeller portion back to the body of water in which the watercraft is operating. Further, an adjustment mechanism is provided for variably adjusting the effective flow area of one of these propulsion unit portions in order to adjust the performance of the unit.

Such adjusting operations may take place automatically in response to the measured value of at least one operating variable. Further, means are provided for communicating the measured value or values to the variable adjusting means so that proper adjustments can be made.

DETAILED DESCRIPTION OF THE PREFERRED EMBODIMENTS

Figure 1:
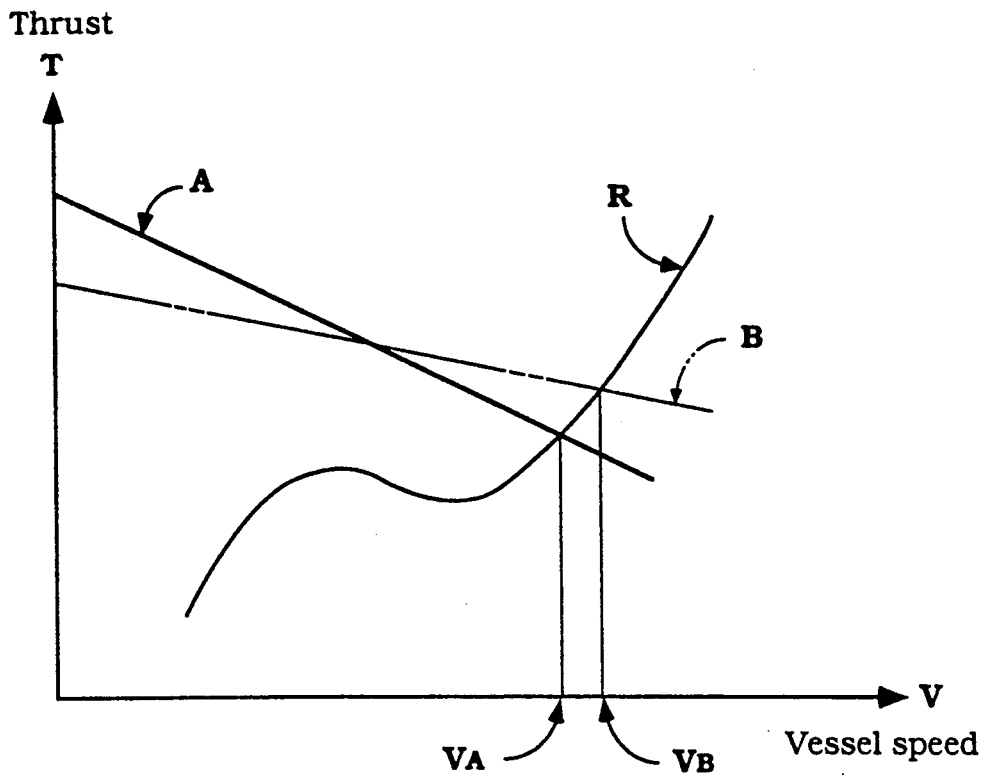
FIG. 1 is a plot relating thrust to speed.
Figure 2:
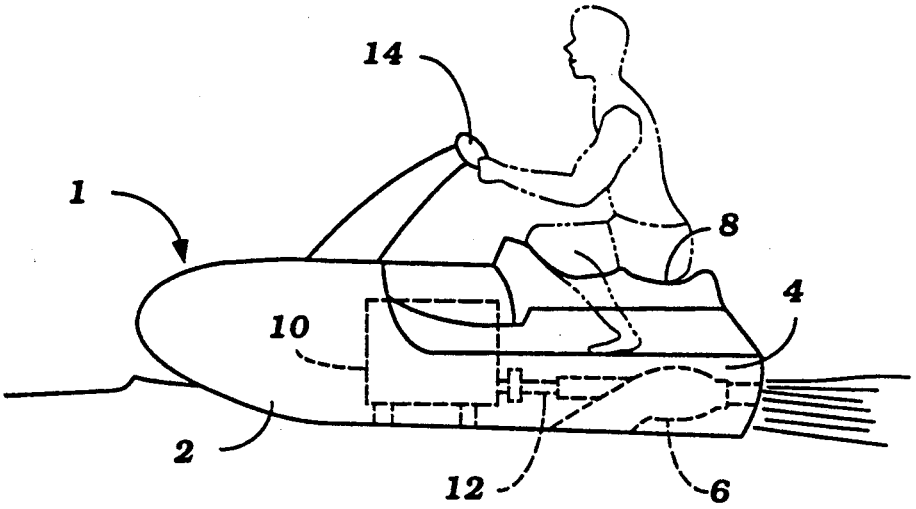
FIG. 2 is a side elevational view, partially broken away, of a jet driven watercraft constructed in accordance with this invention.

Referring now in detail to the drawings, a small watercraft constructed in accordance with the invention is depicted generally in FIG. 2. In the illustrated embodiment, the watercraft is of the type that is designed to be operated by a single rider sitting in straddle fashion on the watercraft. Although the invention has particular utility in conjunction with such types of watercraft, it is to be understood that the invention can be utilized with other types of jet propelled watercraft than that illustrated.

The watercraft 1 is comprised of a hull, indicated generally by the reference numeral 2, and which may be formed from fiberglass reinforced molded resin, or the like. The hull 2 is formed at its rearward end with a tunnel 4. A water jet unit, indicated generally by the reference numeral 6, is positioned within the tunnel 4 beneath the hull 2.

A rider's area such as a seat 8 is positioned on the hull 2 over the tunnel 4 and is adapted to accommodate a single rider, shown in phantom in FIG. 2, seated in a straddle fashion. The rider controls the steering of the watercraft via a handlebar assembly 14 positioned forwardly of the seat 8.

Forwardly of the seat 8, and within an opening formed at the forward portion of the hull 2, there is provided an internal combustion engine, indicated generally by the reference numeral 10, for powering the watercraft. It should be noted that it is desirable to position the engine 10 at a forward location so as to insure good balance of the watercraft. In addition, the engine should be positioned in an area where it will not encroach on the rider's area.

The engine 10 may be of any known type, for example, a two cylinder, in-line crankcase compression, two cycle type. The engine has an output shaft which connects to an input shaft of the water jet unit, forming a power transmitting shaft system, indicated generally by the reference numeral 12.

Figure 3:
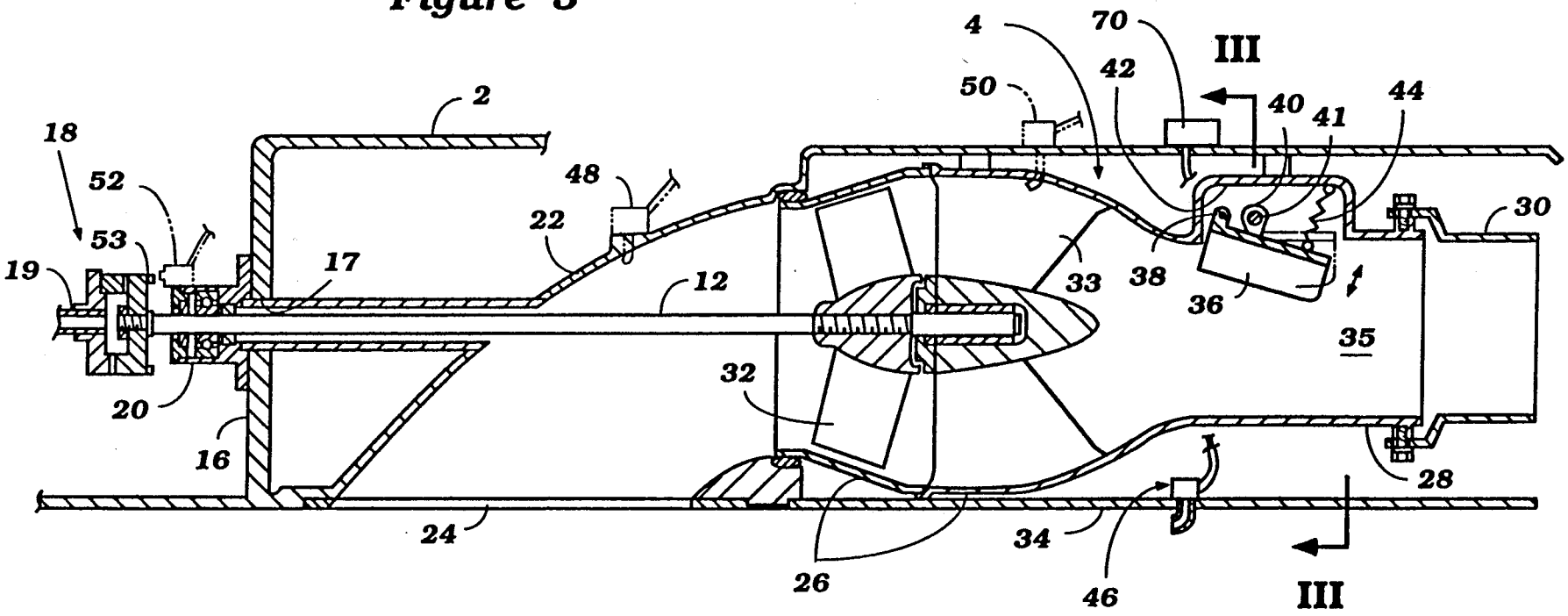
FIG. 3 is a vertical cross sectional view taken through the jet propulsion unit and drive therefore, in accordance with a first embodiment of the invention.

Referring now additionally to FIG. 3, the engine compartment is separated from the tunnel 4 by a generally vertically extending bulkhead 16 that is formed integrally with the hull 2. An opening 17 is provided in the bulkhead 16, through which the power transmitting drive shaft system 12 passes; thereby transmitting power from the vessel engine 10 to the water jet unit 6. Immediately forward of the opening 18 in bulkhead 16 a bearing casing 20 is fastened in place. The drive shaft system 12 is rotatably journaled within this bearing casing 20. A coupling 18 is located slightly forward of the bearing casing 20, joining an output shaft 19 from the engine 10 to the power transmitting drive shaft system 12.

The water jet unit 6 is provided with a water inlet portion 22, formed integrally with the hull 2, which begins at a location beneath the watercraft as a water inlet opening 24. Water is drawn through the inlet opening 24 from the body of water in which the craft is operated, and continues up and into the water inlet portion 22. The water is then drawn into the water jet unit 6, which is comprised of a sectional outer housing 26 having a discharge end 28 to which is mounted a pivotal steering nozzle 30. An impeller 32 is supported within the housing 26 for drawing water through the inlet 24, passing it by straightening vanes 33, also contained within the sectional outer housing 26, and discharging it through the nozzle 30. The rear end of the hull tunnel 4 and the area beneath the rear portion of the water jet unit 6 is closed by a further closure plate 34 that is affixed to the underside of the hull 2.

The invention described herein includes a means for variably adjusting the effective inner area along a portion of the jet unit 6. Optimum vessel acceleration and velocity are thereby achievable under varying operating conditions.

Figure 4:
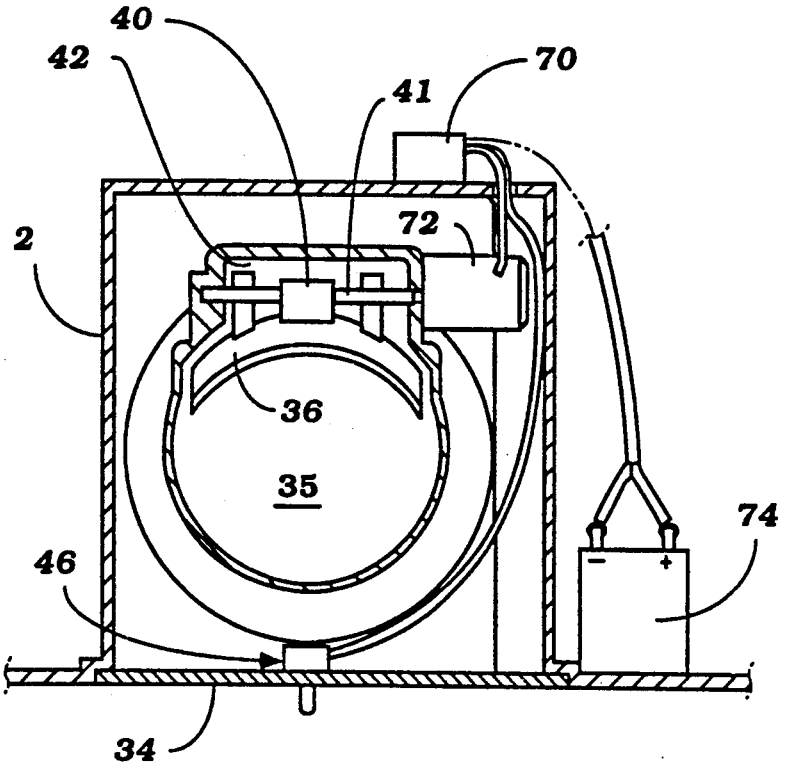
FIG. 4 is a rear cross sectional view taken along the line III—III of FIG. 3.

A first embodiment of the invention is shown in FIGS. 3 and 4. An adjusting plate 36 is pivotally mounted about a pivot shaft 38 at a position along the top of the outer housing 26 in the region of the outlet portion 35. A cam member 40, pivotable about an axle 41, is disposed within a cam chamber 42, positioned behind the adjusting plate 36, within the tunnel 4 of the hull 2. A tension spring 44 is attached on the upper side of the plate 36 and extends to a position along the top rear portion of the cam chamber 42. The tension spring 44 provides a continuous force biasing the plate 36 upward and against the cam member 40. Upon pivoting the cam member 42 downwardly, the biasing force of the spring 44 can be overcome, thereby pivoting the plate 36 downward and into the outlet region 35. Accordingly, the overall area of the outlet region 35 can be reduced.

As mentioned above, such a reduction in the area of the outlet region 35 is desirable under certain operating conditions. In one variation of the embodiment of FIGS. 3 and 4 the critical operating variable is watercraft speed. A pitot tube type vessel speed sensor 46 is positioned beneath the watercraft. The speed sensor 46 is mounted in the closure plate 34 so that it faces forward, with respect to the watercraft, and extends just below the closure plate 34.

In another variation of the embodiment of FIG. 3 the critical operating variable is dynamic water pressure within the water inlet portion 22 and sectional housing 26 of the impeller encasing assembly. A first dynamic water pressure sensor 48 is mounted in an upper portion of the water inlet portion 22, and a second dynamic water pressure sensor 50 is mounted in an upper region of the sectional outer housing 26 behind the impeller 32 and in proximity to the straightening vanes 33.

In yet another variation of the embodiment of FIG. 3 the critical operating variable is impeller shaft rotational speed. A rotational speed detection sensor 52 is positioned atop the bearing casing 20 and detects the impeller shaft rotational speed by monitoring the rotation of a point 53 on the coupling assembly.

In a different variation, not shown in FIG. 3, the critical operating variable is engine rotational speed and is determined by an appropriate sensor (FIG. 5, member 55) placed in proximity to an output member of the engine.

It should be noted that in each of the above-discussed variations the measured values (i.e., watercraft speed, dynamic water pressure, impeller shaft rotational speed, and engine rotational speed) are all employed as ways to determine the vessel speed.

Figure 5:
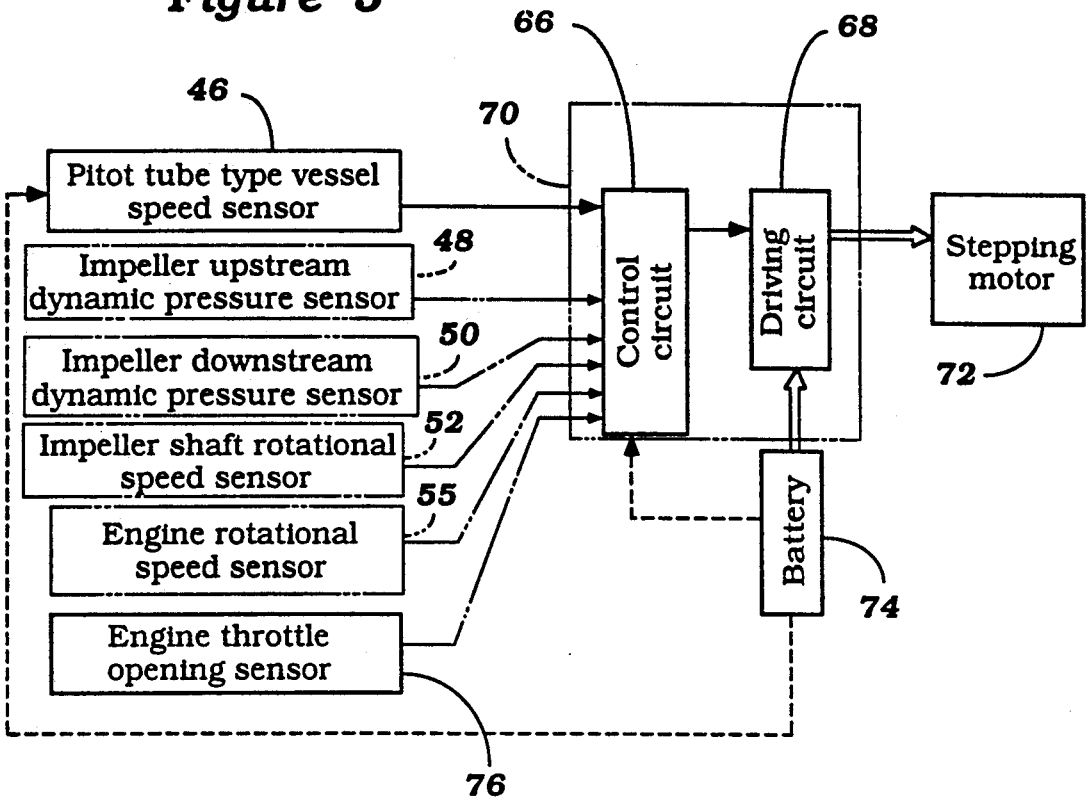
FIG. 5 is a block diagram showing the interrelationship of the various controls.

FIG. 5 is a block diagram showing the interrelationship of the various controls employable in the embodiment of FIG. 3 and the above discussed variations. FIG. 3 illustrates some of these components in the context of the embodiment depicted therein. It should be noted that any one of the sensors (members 46, 48, 50, 52 and 55) employed in detecting and measuring the desired operational variables feed to a control circuit 66 and a driving circuit 68, which together comprise a control unit 70, which, in turn, operates a stepping motor 72, according to the conditions detected, and thereby enlarges or constricts the area of the outlet region 35. A battery 74 provides power for these various operations.

Figure 6:
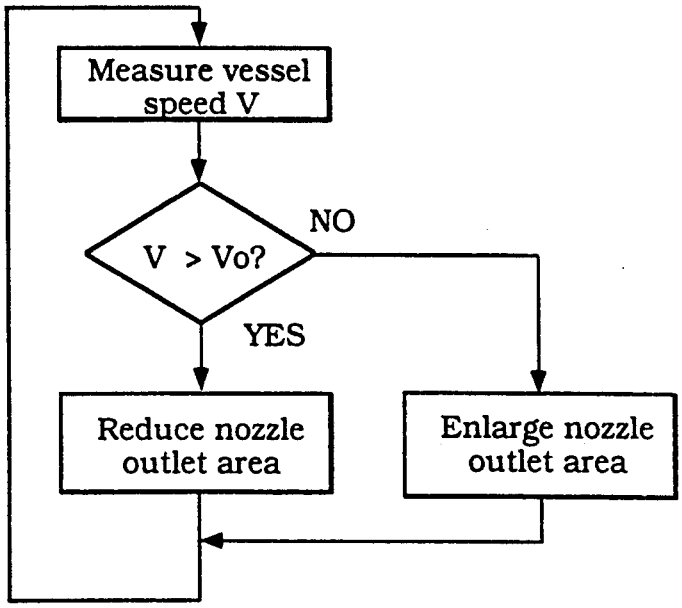
FIG. 6 is a block diagram showing the routine under which the invention operates, in accordance with one embodiment of the invention.

FIG. 6 depicts, in flow chart form, the logic routine which the invention employs in one of the variations of the embodiment of FIG. 3 (i,e., the variation utilizing vessel speed as the critical variable). It should be appreciated that any of the operational variables noted above could be employed in place of, or in concert with, the variable utilized in the Figure. As the flow chart of the Figure illustrates, the vessel speed is measured first, then this value is compared to a predetermined fixed value; if the vessel speed exceeds the predetermined fixed value, the outlet area is reduced; and if the vessel speed does not exceed the predetermined fixed value, the outlet area is enlarged.

Figure 7:
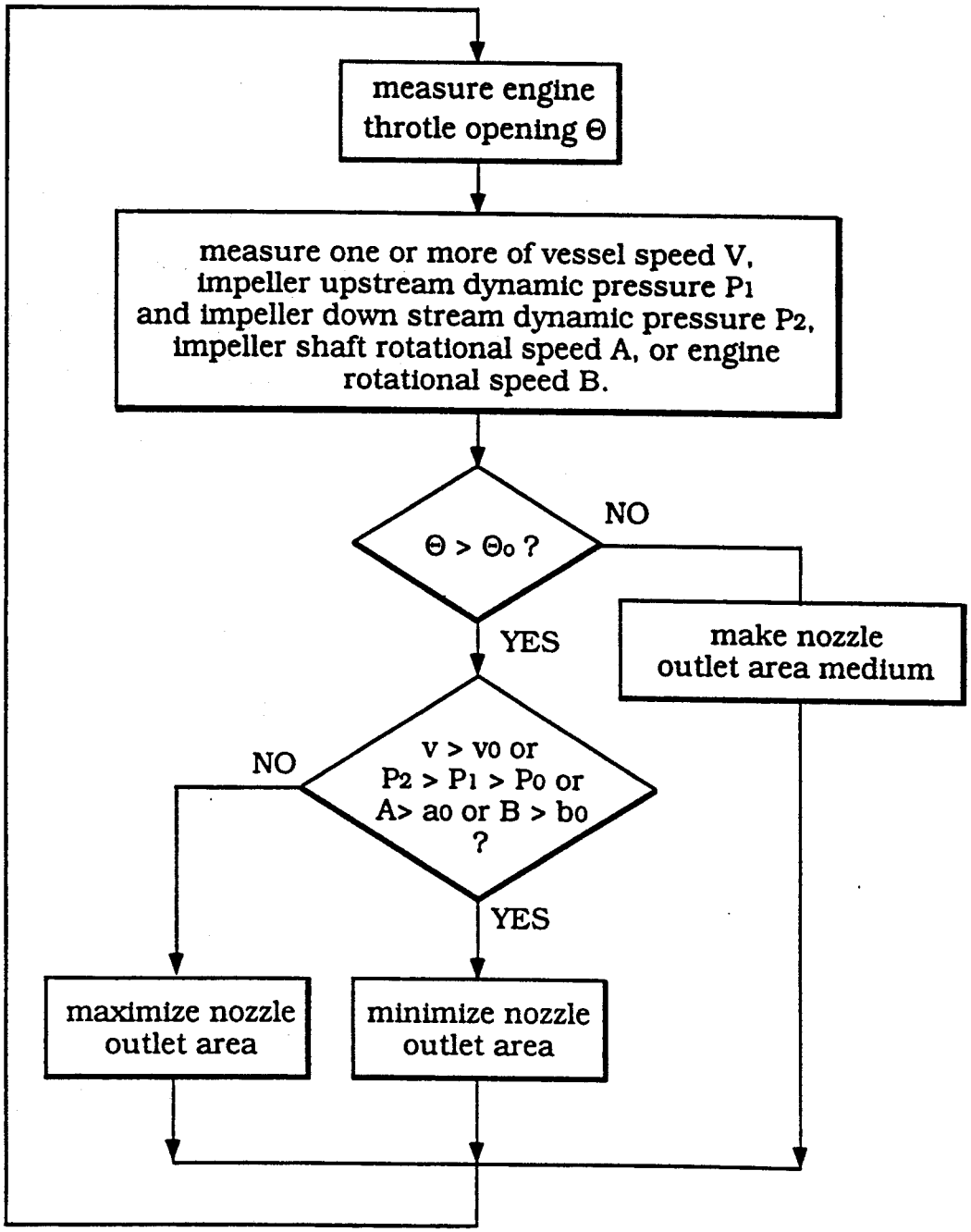
FIG. 7 is a block diagram showing the routine under which the invention operates, in accordance with another embodiment of the invention.

FIG. 7 shows the same logic routine of FIG. 6, but precedes the routine of FIG. 6 with an additional procedure. In FIG. 7, the first operational variable measured is the angle of engine throttle opening. If the measured angle exceeds a predetermined fixed value, then the routine of FIG. 6 is followed. If the measured angle of engine throttle opening does not exceed the predetermined fixed value, then the outlet area is set at a medium position, and the routine is repeated. FIG. 5 shows the interrelationship of the engine throttle opening sensor 76 with the other elements of the control system discussed above.

FIGS. 8-13 show several additional embodiments of means for reducing or enlarging the outlet area.

Figure 8:
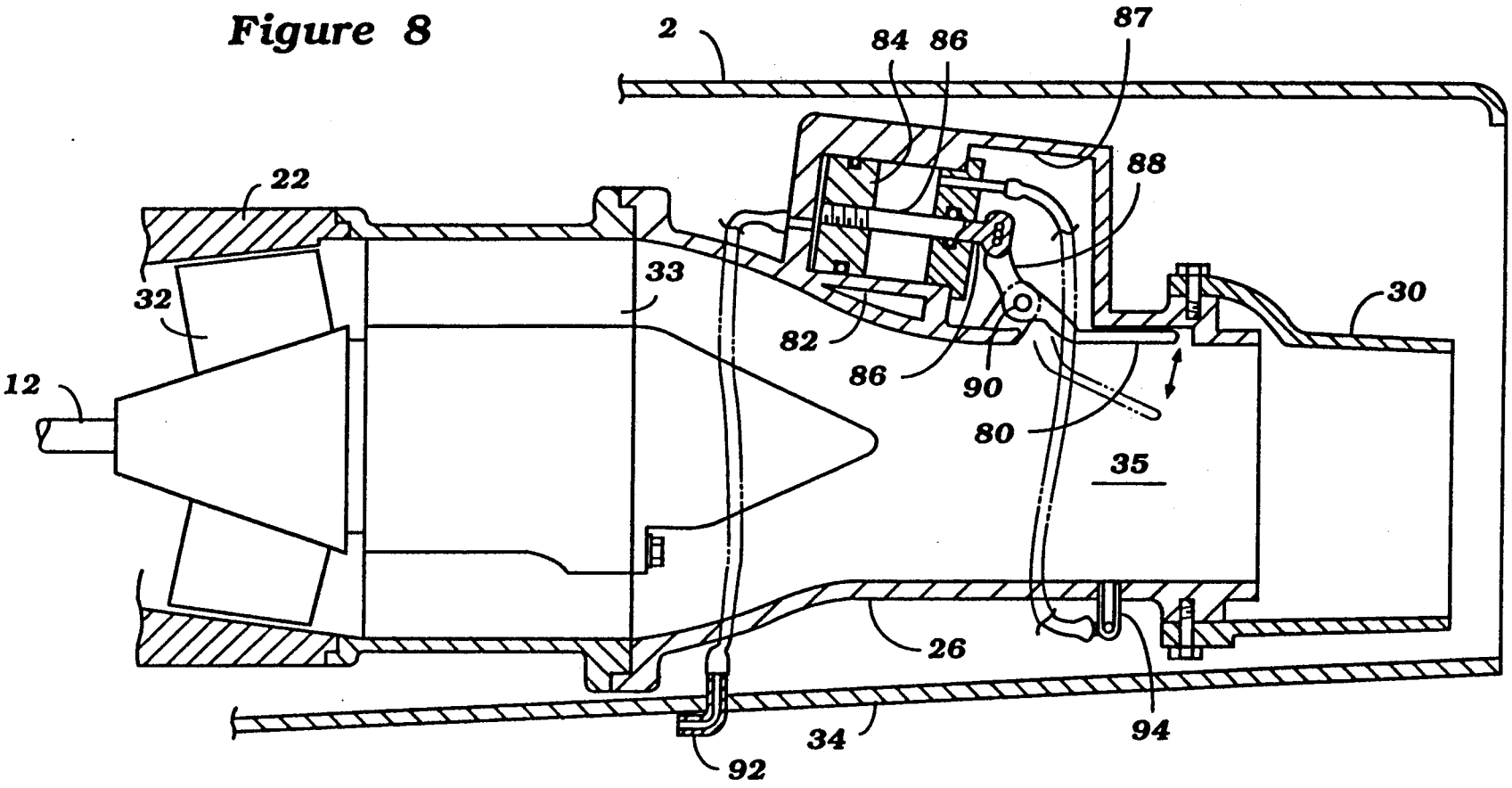
FIG. 8 is a vertical cross sectional view taken through the jet propulsion unit, in accordance with a second embodiment of the invention.

In the embodiment of FIG. 8, an adjusting plate 80, similar to the plate 36 of FIGS. 3 and 4, is employed to variably adjust the outlet area. In this embodiment, however, adjustments of the plate 80 are effected by a piston and cylinder arrangement. A cylinder 82 is positioned along an upper portion of the impeller assembly outer housing 26. The cylinder may, in fact, be integrally formed with the outer housing 26, as shown in the Figure.

A piston 84 is disposed within the cylinder, for back and forth movement therein. A piston rod 86 is connected at one end to the piston 84, and at its other end terminates as a flanged head. The flanged head portion of the piston rod 86 is pivotally connected to a forwardmost portion of the adjusting plate 80, which forms a leverage arm portion 88. As the piston 84 moves from its forwardmost position within the cylinder 82 (as shown) to its rearwardmost position, the leverage arm portion 88 of the adjusting plate 80 is moved rearwardly via its pivotal connection to the flanged head of the piston rod 86. Such rearward movement of the leverage arm portion 88 causes the adjusting plate 80 to pivot about its pivot shaft 90, thereby lowering the rearwardmost portion of the adjusting plate 80 into the outlet region 35. Accordingly, the area of the outlet region 35 is decreased.

A first elongated tube 92 communicates with the forwardmost portion of the cylinder 82. The tube 92 extends from this position downwardly to a region just beneath the bottom of the watercraft, where it is mounted within the closure plate 34, as shown in FIG. 8. The opening of the tube 92 under the watercraft is positioned so that it faces in a forward direction with respect to the watercraft. A second elongated tube 94 communicates with the rearwardmost portion of the cylinder 82. The second tube 94 extends from this position downwardly to a location just below the outlet region 35 and beneath the outer housing 26, yet above the closure plate 34.

As the watercraft 1 moves across a body of water, a water pressure, corresponding to the speed of the vehicle, will be incurred at the forwardly facing lower portion of tube 92. This pressure will be communicated within the tube upward to the forwardmost portion of the cylinder 82. When the pressure exerted upon the forward facing side of the piston 84 exceeds the pressure existing in the rearward portion of the cylinder 82, the piston will be moved in a rearward direction, and accordingly, the adjusting plate will be lowered into the outlet region 35, in the manner discussed above, and the area in the outlet region 35 will be decreased.

Figure 9:
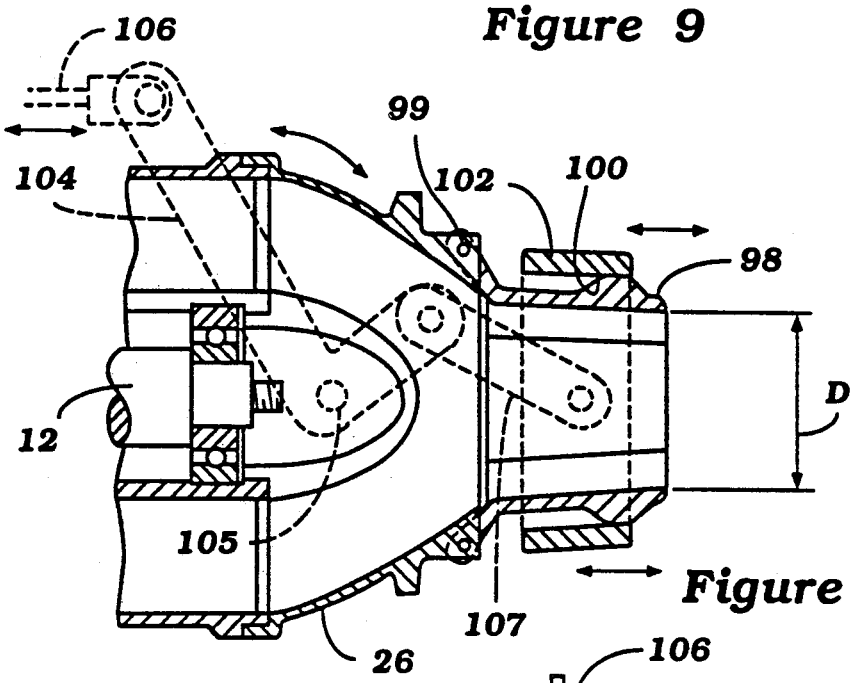
FIG. 9 is a vertical cross sectional view taken through a portion of the jet propulsion unit, in accordance with a third embodiment of the invention.
Figure 10:
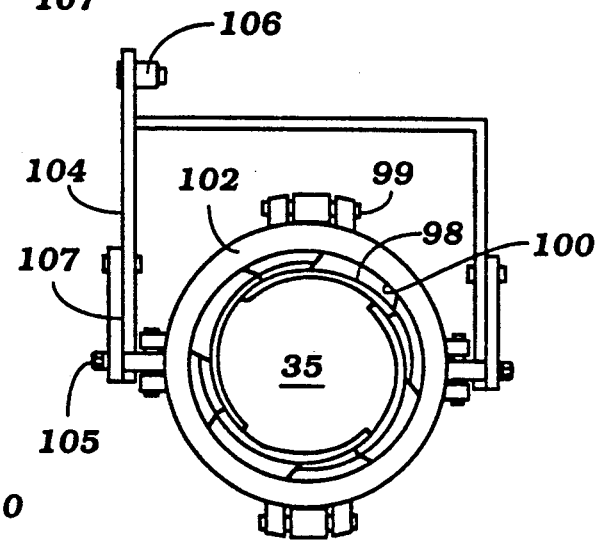
FIG. 10 is a rear elevational view of the jet propulsion unit in accordance with the embodiment of FIG. 9.

In the embodiment of the invention depicted in FIGS. 9 and 10 a plurality of semi-cylindrical plates 98 are pivotally connected, via hinges 99 to the rearwardmost circular rim of the outer housing 26 which surrounds the outlet region 35. A circular flange 100 is formed integrally with the plates 98 and runs along an outer portion thereof. A cylindrical actuator 102 is positioned around the outer perimeter of the plates and is moveable in forward and reverse directions. The actuator 102 is constructed with a progressively decreasing diameter from its forwardmost end toward its rearwardmost end, as illustrated in FIG. 9. The actuator 102 is positioned so that it engages the circular flange 100. As the actuator 102 is moved from its rearwardmost to its forwardmost (shown) position, its engagement with the flanged portion 100 of the plates 98 causes the plates 98 to pivot inwardly, towards one another, thereby decreasing the outlet region 35 area.

Movement of the actuator 102 is effected by moving rod member 106 in a forward or rearward direction. Upon such movement of the rod member 106, movement is imparted to the actuator 102 through several hingedly connected bars 104 and 107. Specifically, movement of the rod 106 causes pivotal movement of the L-shaped bar member 104 about a pivot shaft 105, which, in turn, moves the bar member 107 either forwardly or rearwardly, as desired. The bar member 107 is hingedly connected to the actuator 102, and thus moves the actuator 102 upon the bar member's own movement.

Figure 11:
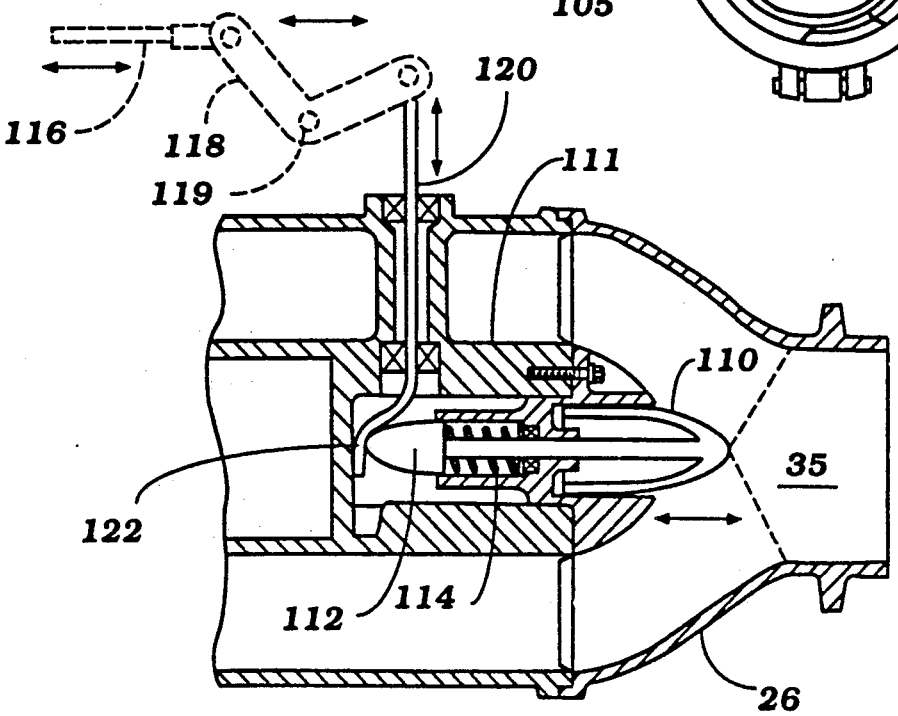
FIG. 11 is a vertical cross sectional view taken through a portion of the jet propulsion unit, in accordance with a forth embodiment of the invention.

FIG. 11 shows a further embodiment of the invention wherein a bullet-shaped adjusting cone 110 is moveable in and out of the outlet region 35, thereby adjusting the area of the region. The adjusting cone 110 is housed within a hub 111 of the impeller assembly. A forwardmost portion of the cone member 110 is flanged and forms an actuator 112. A spring 114 is also housed within the hub 111, around a shaft connecting the cone portion 110 and the actuator 112, and provides a forward biasing force against the actuator, thereby positioning the adjusting cone 110 out of the outlet region 35, and maximizing the outlet region's area.

A rod and lever assembly is utilized to overcome the spring force, thereby moving the cone member 110 rearwardly, and into the outlet region 35 in order to reduce the area of that region. Specifically, movement of the rod member 116 induces movement of the L-shaped bar member 118 about its pivot shaft 119. When rod member 116 is moved a rearward direction, S-shaped rod member 120 is moved downwardly, by the pivotal movement of bar member 118. As the rod 120 moves downward, its curved portion 122 slides past, and against, the actuator 112, moving the actuator 112, and therefore the adjusting cone 110, rearwardly.

Figure 12:
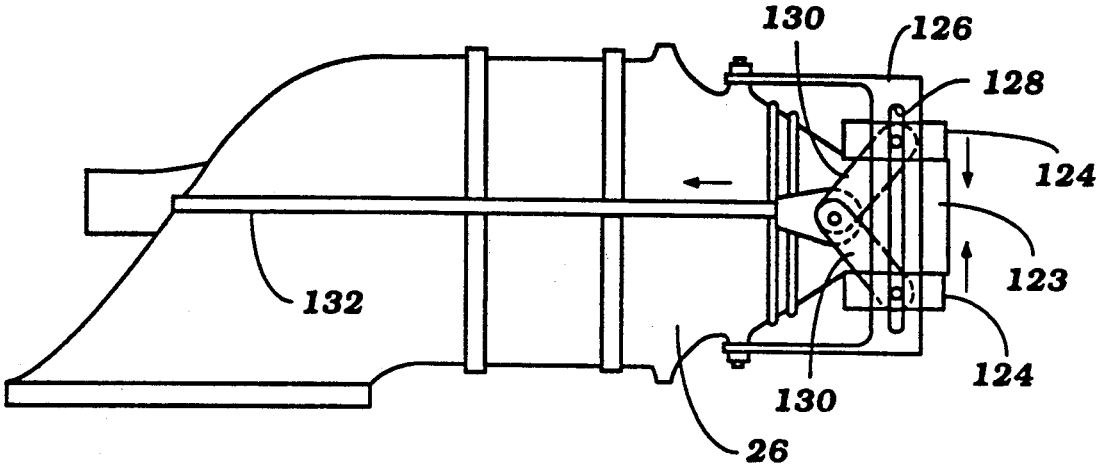
FIG. 12 is a side elevational view of the jet propulsion unit in accordance with a fifth embodiment of the invention.
Figure 13:
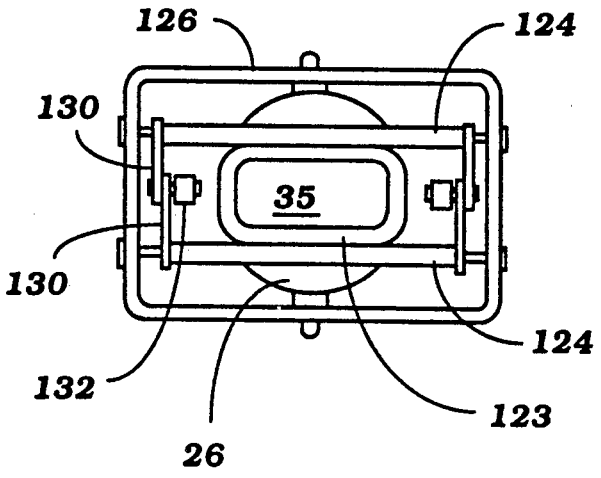
FIG. 13 is a rear elevational view of the jet propulsion unit in accordance with the embodiment of FIG. 12.

FIGS. 12 and 13 show yet a further embodiment for adjusting the outlet region 35 area. A compressible outlet nozzle 123 is positioned at the rearwardmost end of the water injection propulsion unit. A pair of parallel bars 124, together forming a gripping actuator, are positioned on opposite sides of the compressible nozzle 123. Movement of the bars 124 towards one another causes the nozzle to compress, thereby reducing the area of the outlet region 35. Mutually inward movement of the bars 124 is effected by initiating a rearward movement of the horizontally disposed elongated rod 132. Such movement causes bar members 130 to close in a scissor-like fashion, with their rearwardmost ends, hingedly connected to the parallel bar members 124, following along the guide provided by an elongated slot 128 of the frame structure 126.

The above-discussed embodiments involve control mechanisms located within the outlet region 35 of a water injection propulsion unit. Of course, the same results of increased accelerability at low vessel speeds and increased accelerability and maximization of top attainable speed at high vessel speeds could likewise be achieved by providing similar control mechanisms at other regions of the propulsion unit; for example, in the inlet portion 22 of the water injection nozzle.

Figure 14:
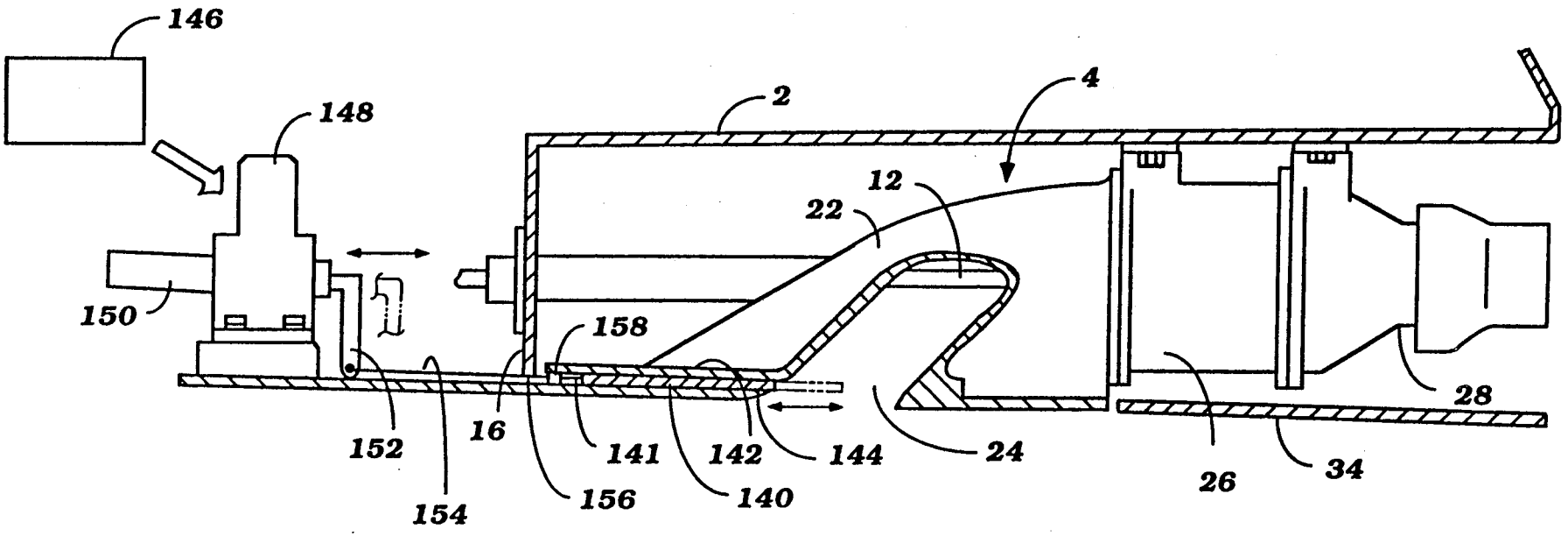
FIG. 14 is a side elevational view of the jet propulsion unit in accordance with a sixth embodiment of the invention.

An embodiment of the invention showing such a control mechanism located within the inlet portion 22 of a water injection propulsion unit is depicted in FIG. 14. In the embodiment shown, a movable plate 140 is slidably receivable within a holding slot 141 which comprises parallel, horizontally disposed upper and lower plates 142 and 144 positioned in a forward, lower region of the tunnel 4 and in close proximity to one another. The movable plate 140 is rearwardly slidable and variably positionable from a forwardmost position, at which the movable plate 140 does not extend into the water inlet opening 24, to a rearwardmost position, at which the movable plate partially extends across a forwardmost portion of the water inlet opening 24, thus limiting the amount of water which may enter the water injection propulsion unit.

A control unit 146 controls an electric motor and fluid pump 148, which, in turn, controls a fluid cylinder 150 to slide the movable plate 140 as required according to measured values of pertinent variables determined in accordance with any of the above-described embodiments. A linkage arrangement, connecting the fluid cylinder 150 to the movable plate 140, comprises an L-shaped arm 152 extending outwardly and downwardly from the rearward end of the fluid cylinder assembly; and, a straight rod member 154 connected at one end to the lowermost portion of the L-shaped member 152 and at the other end to a forwardmost portion of the movable plate 140. The straight rod member 154 extends through a small opening 156 in the bulkhead 16 and also through an opening 158 in a forwardmost portion of the holding slot 141 in order to make this connection.

It should also be noted that in all of the above-discussed embodiments, a steering nozzle could be mounted along the back end of the outlet region. Such a nozzle is shown in FIGS. 3 and 8, but is not shown in the Figures dipicting the other embodiments; however, it is equally applicable to these Figures as well.

Figure 15:
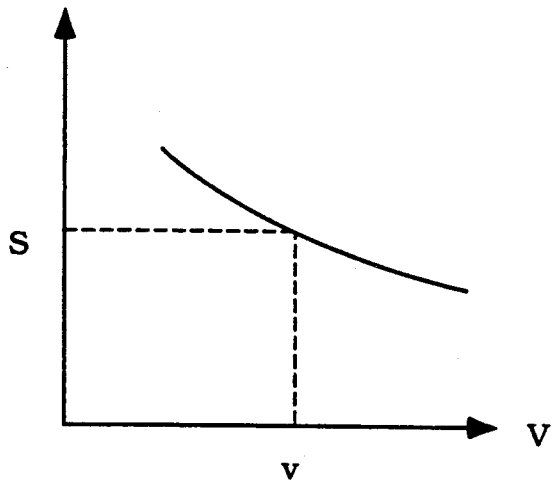
FIG. 15 is a curve showing the optimum area for a water outlet region versus vessel speed.

The curve of FIG. 15 shows the optimum area (S) for the water outlet region versus the vessel speed (v).

It should be readily apparent from the foregoing description that a number of embodiments of the invention have been illustrated and described each of which is effective to allow attainment of optimum vessel accelerability at low to medium speeds and optimum accelerability and top speed at high speeds. Although a number of embodiments of the invention have been illustrated and described, it should be readily apparent to those skilled in the art that various changes and modifications may be made without departing from the spirit and scope of the invention, as defined by the appended claims.

We claim:

1. A water injection propulsion unit for a jet powered watercraft comprising a water flow pathway defined by a water inlet portion for admitting water to said unit, an impeller portion for containing an impeller for pumping water, and a discharge portion for discharging water from said impeller portion back to the body of water in which the watercraft is operating, wherein said discharge portion is provided with an outlet at an extreme rearwardmost region thereof; said water injection propulsion unit further comprising an adjustment mechanism for variably adjusting the effective flow area of one of said portions to adjust the performance of said unit, wherein said adjustment mechanism is located upstream of said outlet throughout said adjustment mechanism's operative range of movement; and wherein said adjustment mechanism is movable outside of said water flow pathway.

2. The water injection propulsion unit of claim 1 wherein said adjustment mechanism for variably adjusting said effective flow area within said water injection propulsion unit is located along said water discharge portion.

3. The water injection propulsion unit of claim 1 wherein said adjustment mechanism for variably adjusting said effective flow area within said water injection propulsion unit is located along said water inlet portion.

4. The water injection propulsion unit of claim 1 wherein said adjustment mechanism for variably adjusting said effective flow area within said water injection propulsion unit is located in a region between said water inlet portion and said water discharge portion.

5. The water injection propulsion unit of claim 1 wherein said adjustment mechanism is an automatically operative adjustment mechanism.

6. The water injection propulsion unit of claim 5 wherein said automatically operative adjustment mechanism for variably adjusting the effective flow area of one of said portions of said water injection propulsion unit is operative in response to at least one operating variable and means are provided for measuring a value, for each such operating variable, and said measuring means are in communication with said automatically operative adjustment mechanism.

7. The water injection propulsion unit of claim 6 wherein said at least one operating variable, measured by said measuring means, is vessel speed, and said effective flow area of one of said portions is enlarged when said measured vessel speed is lower than a predetermined fixed value, and said effective flow area of one of said portions is constricted when said vessel speed is higher than said predetermined fixed value.

8. The water injection propulsion unit of claim 7 wherein a pitot tube speed sensor is positioned along a lower portion of said watercraft and continuously measures said vessel speed.

9. The water injection propulsion unit of claim 6 wherein said measured operating variable is dynamic pressure, measured at a location upstream of said impeller of said watercraft and also at a location downstream of said watercraft impeller by dynamic pressure sensors positioned along these regions, and said effective flow area of one of said portions is constricted when said downstream pressure is higher than said upstream pressure and said upstream pressure is higher than a predetermined fixed value.

10. The water injection propulsion unit of claim 6 wherein said measured operating variable is impeller rotational speed measured by a sensor located in proximity to a power input coupling of said impeller and said effective flow area of one of said portions is constricted when said measured impeller rotational speed exceeds a predetermined fixed value.

11. The water injection propulsion unit of claim 6 wherein said measured operating variable is engine rotational speed measured by a sensor located in proximity to an output shaft of an engine of said watercraft and said effective flow area of one of said portions is constricted when said measured engine rotational speed exceeds a predetermined fixed value.

12. The water injection propulsion unit of claim 6 wherein the first variable measured, in time, of said measured operating variables, is an angle of engine throttle opening, measured by a sensor in proximity to an engine throttle, and said measured angle of engine throttle opening is subsequently compared against a predetermined fixed value.

13. The water injection propulsion unit of claim 12 wherein said effective flow area of one of said portions is set at a medium opening if said measured angle of engine throttle opening is not greater than said predetermined fixed value.

14. The water injection propulsion unit of claim 12 wherein if said measured angle of engine throttle opening is geater than said predetermined fixed value, next a value corresponding to vessel speed is measured, and said effective flow area of one of said portions is enlarged when said measured vessel speed is lower than a predetermined fixed value, and said effective flow area of one of said portions is constricted when said vessel speed is higher than said predetermined fixed value.

15. The water injection propulsion unit of claim 14 wherein a pitot tube speed sensor is positioned along a lower portion of said watercraft and continuously measures said vessel speed.

16. The water injection propulsion unit of claim 12 wherein if said measured angle of engine throttle opening is greater than said predetermined fixed value, next a value corresponding to dynamic pressure is measured at a location upstream of an impeller of said watercraft and also at a location downstream of said watercraft impeller by dynamic pressure sensors positioned along these regions, and said effective area of one of said portions is constricted when said downstream pressure is higher than said upstream pressure and said upstream pressure is higher than a predetermined fixed value.

17. The water injection propulsion unit of claim 12 wherein if said measured angle of engine throttle opening is greater than said predetermined fixed value, next a value corresponding to impeller rotational speed is measured by a sensor located in proximity to a power input coupling of said impeller and said effective area of one of said portions is constricted when said measured impeller rotational speed exceeds a predetermined fixed value.

18. The water injection propulsion unit of claim 12 wherein if said measured angle of engine throttle opening is greater than said predetermined fixed value, next a value corresponding to engine rotational speed is measured by a sensor located in proximity to an output shaft of an engine of said watercraft and said effective area along one of said portions is constricted when said measured engine rotational speed exceeds a predetermined fixed value.

19. The water injection propulsion unit of claim 2 wherein said means for adjusting said area along a region within said water injection nozzle comprises an adjusting plate pivotally mounted about a fixed pivot shaft in proximity to said water discharge portion and which is movable into said water discharge portion, thereby decreasing said effective flow area of said unit.

20. The water injection propulsion unit of claim 19 further comprising means for biasing said adjusting plate out of said water discharge portion.

21. The water injection propulsion unit of claim 20 wherein a pivotable cam member is disposed within a cam chamber, said cam chamber being positioned behind said adjusting plate within a jet propulsion unit tunnel formed within a hull of the watercraft, and said cam member engages an outward, cam facing side of said adjusting plate so that said adjusting plate can be pivotally moved into said water discharge portion about said fixed pivot shaft upon movement of said cam member.

22. The water injection propulsion unit of claim 21 wherein said biasing means comprises a spring member attached at one end to said outward, cam facing side of said adjusting plate and attached at the other end to a rearward portion of said cam chamber.

23. The water injection propulsion unit of claim 22 wherein a stepping motor communicates with said cam member through an elongated axle so that said cam member may be adjusted according to rotation imparted to it from said stepping motor by way of said elongated axle.

24. The water injection propulsion unit of claim 23 further comprising a control circuit and a driving circuit which, together, form a control unit which communicates with, and controls operations of, said stepping motor.

25. The water injection propulsion unit of claim 24 further comprising a battery in communication with said control circuit, for providing electric power to said control circuit.

26. The water injection propulsion unit of claim 19 further comprising a piston, a cylinder within which said piston is disposed, said cylinder located in proximity to said water discharge portion, a piston rod fastened at its forwardmost end to said piston, and a piston rod head located at a rearwardmost end of said piston rod outside of said cylinder, and a forwardmost end of said adjusting plate forming a leverage arm, said leverage arm connected at its forwardmost end to said piston rod head, and a rearwardly extending portion of said adjusting plate, said rearwardly extending portion of said adjusting plate pivotally moveable into said water discharge portion about said pivot shaft, upon rearward movement of said piston rod.

27. The water injection propulsion unit of claim 26 further comprising a first elongated tube, with one end of said first elongated tube in communication with a forwardmost portion of said cylinder, said first elongated tube extending from said forwardmost portion of said cylinder to a location below said watercraft, and a second end of said first elongated tube having an opening, said opening of said first elongated tube positioned such that said opening faces in a forward direction with respect to said watercraft; and, further, a second elongated tube, said second elongated tube in communication with a rearwardmost portion of said cylinder, said second elongated tube; extending from said rearwardmost portion of said cylinder to a location below said water discharge portion of said injection propulsion unit.

28. The water injection propulsion unit of claim 2 further comprising a hub located centrally within said water injection propulsion unit and a generally cone-shaped member, said cone-shaped member disposed within said hub facing rearwardly with respect to said watercraft, and rearwardly slidable, so that upon such rearward movement said cone-shaped member extends partially into said water discharge region, thereby decreasing the overall effective area of said water discharge region.

29. The water injection propulsion unit of claim 28 further comprising a spring member and a flanged portion of said cone-shaped member, both members being disposed within said hub and positioned with said spring member's forwardmost end against a rearwardly located side of said flanged portion of said cone-shaped member so that a forwardly extending force is constantly exerted upon said flanged portion, thereby biasing the rearwardmost portion of said cone-shaped member out of said water discharge portion.

30. The water injection propulsion unit of claim 29 further comprising a mechanical lever assembly having an elongated rod extending from a position outside of said water injection unit to a position within said hub and in contact with said forward end of said flanged portion of said cone-shaped member; said elongated rod being movable to exert a rearwardly extending force upon said flanged portion of said cone-shaped member, overcoming said forwardly extending force of said spring member, thereby moving said entire cone-shaped member rearwardly, and thus, into said water discharge portion.

31. The water injection propulsion unit of claim 3 wherein said adjustment mechanism comprises a movable plate member and a holding slot, said plate member slidable within said holding slot; and a water inlet opening located at a lower forward region of said water inlet portion, said holding slot positioned immediately forward of said water inlet opening, so that upon rearward movement of said movable plate member said movable plate member extends across a portion of said water inlet opening.

32. The water injection propulsion unit of claim 31 further comprising an electric motor and fluid pump assembly, and a fluid cylinder containing a piston and rod member; wherein said electric motor and fluid pump assembly control movement of said piston and rod member within said fluid cylinder; and further, a linkage arrangement connecting said piston and rod assembly to said movable plate member.

33. The water injection propulsion unit of claim 32 wherein said linkage arrangement comprises an L-shaped arm extending outwardly and downwardly from a rearwardmost portion of said fluid cylinder and a rod connected at a first end to a lower portion of said L-shaped arm and connected at a second end to a forwardmost end of said movable plate member.

* * * * *